United States Patent [19]

Jurascheck et al.

[11] 4,261,288

[45] Apr. 14, 1981

[54] APPARATUS FOR REINFORCING TEXTILE FABRICS BY COATING THEM WITH PLASTIC

[75] Inventors: Richard Jurascheck; Albrecht Kaiser, both of Vlotho, Fed. Rep. of Germany

[73] Assignee: Herbert Kannegiesser GmbH & Co., Vlotho, Fed. Rep. of Germany

[21] Appl. No.: 77,688

[22] Filed: Sep. 21, 1979

[30] Foreign Application Priority Data

Sep. 25, 1978 [DE] Fed. Rep. of Germany ..... 2841594

[51] Int. Cl.[3] ..... B05C 1/02

[52] U.S. Cl. ..... 118/642; 118/212; 118/221

[58] Field of Search ..... 118/211, 212, 221, 58, 118/641, 642, 643; 427/285, 56.1

[56] References Cited

U.S. PATENT DOCUMENTS

| | | | |
|---|---|---|---|
| 2,116,289 | 5/1938 | Shepherd | 118/212 |
| 3,155,538 | 11/1964 | Schneider et al. | 118/58 X |
| 4,009,301 | 2/1977 | Heckman et al. | 118/642 X |
| 4,194,030 | 3/1980 | Fassina | 118/212 X |

*Primary Examiner*—John P. McIntosh

*Attorney, Agent, or Firm*—Sughrue, Rothwell, Mion, Zinn and Macpeak

[57] ABSTRACT

A textile piece 10 is transported by a conveyor belt 14 through the nip between a compression cylinder 15 and an underlying pressure roller 17, whereat lines of reinforcing plastic carried by parallel grooves in the cylinder are applied to the piece. It thereafter passes through a dryer 18, and both the cylinder and the dryer extend across about ⅔ of the conveyor width with the dryer housing 35 being spaced above the conveyor on both ends and one side. This arrangement enables either full or partial line coating of textile pieces which are transversely placed on the conveyor, and avoids heating the uncoated portions of the pieces.

3 Claims, 4 Drawing Figures

APPARATUS FOR REINFORCING TEXTILE FABRICS BY COATING THEM WITH PLASTIC

BACKGROUND OF THE INVENTION

The invention relates to an apparatus for reinforcing textile fabrics of different shapes for outerwear material by coating them with plastic, and comprises a device for coating the fabrics and a device for their subsequent heat treatment as well as a belt for conveying the fabrics through these devices. The coating device includes a compression cylinder, and the device for heat treatment comprises a pass-through dryer.

In FIG. 3 of German OS No. 2,552,878, a device of the above-described type is shown in which the compression cylinder is mounted above the transport belt. The compression cylinder is preferably equipped for roller printing and has parallel grooves running parallel to the longitudinal axis for receiving the coating thereof. The textile fabrics lying on the transport belt are coated with lines of plastic by the compression cylinder. The coating lines thus lie transverse to the direction of movement of the textile fabrics. The parallel grooves of the compression cylinder can extend both over the entire operational range of the device or of the compression cylinder, as well as only over two fifths thereof. With the latter embodiment of the compression cylinder only a partial coating of uncut cloth or material strips is provided. The above-mentioned German OS states that the grooves of the compression cylinder can also be arranged in other ways, for example in the form of diagonal lines or circumferential lines. Concerning the pass-through dryer, the only mention made in the German OS is that this can be a simple radiation heating unit. The transport belt is divided into two parts. A portion thereof is associated with the compression cylinder, and another portion is associated with the pass-through dryer.

It is also known to coat blanks for the manufacture of clothing in other ways, both as relates to the surface as well as to the type of coating used. The German OS contains examples in this regard. If a linear coating is applied to the blanks, which is particularly advantageous, then they should if possible be parallel to the woof direction of the web of the blanks. If coating is performed with the mentioned device in this sense, then especially the front portions of jackets and coats must be conveyed lengthwise through the device. If only a portion of the blanks are to be coated, then the pressure roller is raised to a distance from the compression cylinder at which a coating of the blanks does not take place. The blanks are also conveyed in this instance primarily lenghtwise through the device. The conveying of the blanks or textile fabrics lengthwise through the device depends on the arrangement of the parallel grooves of the compression cylinder along the axis thereof, the above-mentioned embodiment of the compression cylinder with regard to the non-coating of portions of the textile fabric and the conveyance after coating in the form of parallel lines which should run parallel to the woof direction of the web of textile fabric. This type of coating or non-coating of the textile fabrics as well as the above-described embodiment of the device is, however, disadvantageous for many reasons, in particular from the point of view of difficulty of operation and in regard to the performance of the device. A further disadvantage is that with a partial coating of the textile fabric, the uncoated surfaces are also subjected to the effects of heat in the dryer. This means the non-coated surfaces of the textile fabrics are overheated and possibly even singed.

SUMMARY OF THE INVENTION

The basic objective of the invention is to provide a device which is easier to operate, has a higher performance than those previously known, and largely avoids any effective heating of non-coated surfaces of the textile fabric. The apparatus is particularly advantageous for the manufacturer of ready-made clothing, who cannot set up two or more devices with different compression cylinders and still operate them economically.

Briefly, and according to the present invention, textile pieces are transported by a conveyor belt through the nip between a compression cylinder and an underlying pressure roller. The cylinder is provided with a plurality of spaced, parallel grooves perpendicular to the cylinder axis which carry the reinforcing plastic coating material. Thus, parallel lines of plastic are applied to the textile pieces as they pass under the cylinder, whereafter they are conveyed through a radiation dryer. Both the compression cylinder and the dryer extend across only about two thirds of the conveyor width, and the dryer housing is spaced slightly above the conveyor on both ends to provide the usual entry and exit slots, and is also so spaced along the full length of its side that lies above the conveyor belt. With such an arrangement elongated pieces of textile fabric may be placed transversely across the conveyor belt and selectively positioned such that either their full length passes under the compression cylinder and through the dryer, or such that only a portion of their length passes under and is coated by the cylinder and subsequently dried. With the latter alternative the remaining portions of the fabric pieces that the not coated lie on the remaining one third of the width of the conveyor belt not covered by the compression cylinder and dryer, whereby the unnecessary heating of the uncoated portions of the pieces is avoided as they simply extend out through the side slot of the dryer housing during their transport. This transverse disposition of the textile pieces across the conveyor belt also enables the overall apparatus to be considerably shorter in length than those of the prior art, and results in a far more versitile apparatus and greatly facilitates its operation.

DETAILED DESCRIPTION OF THE PREFERRED EMBODIMENT

Figures 1, 2:
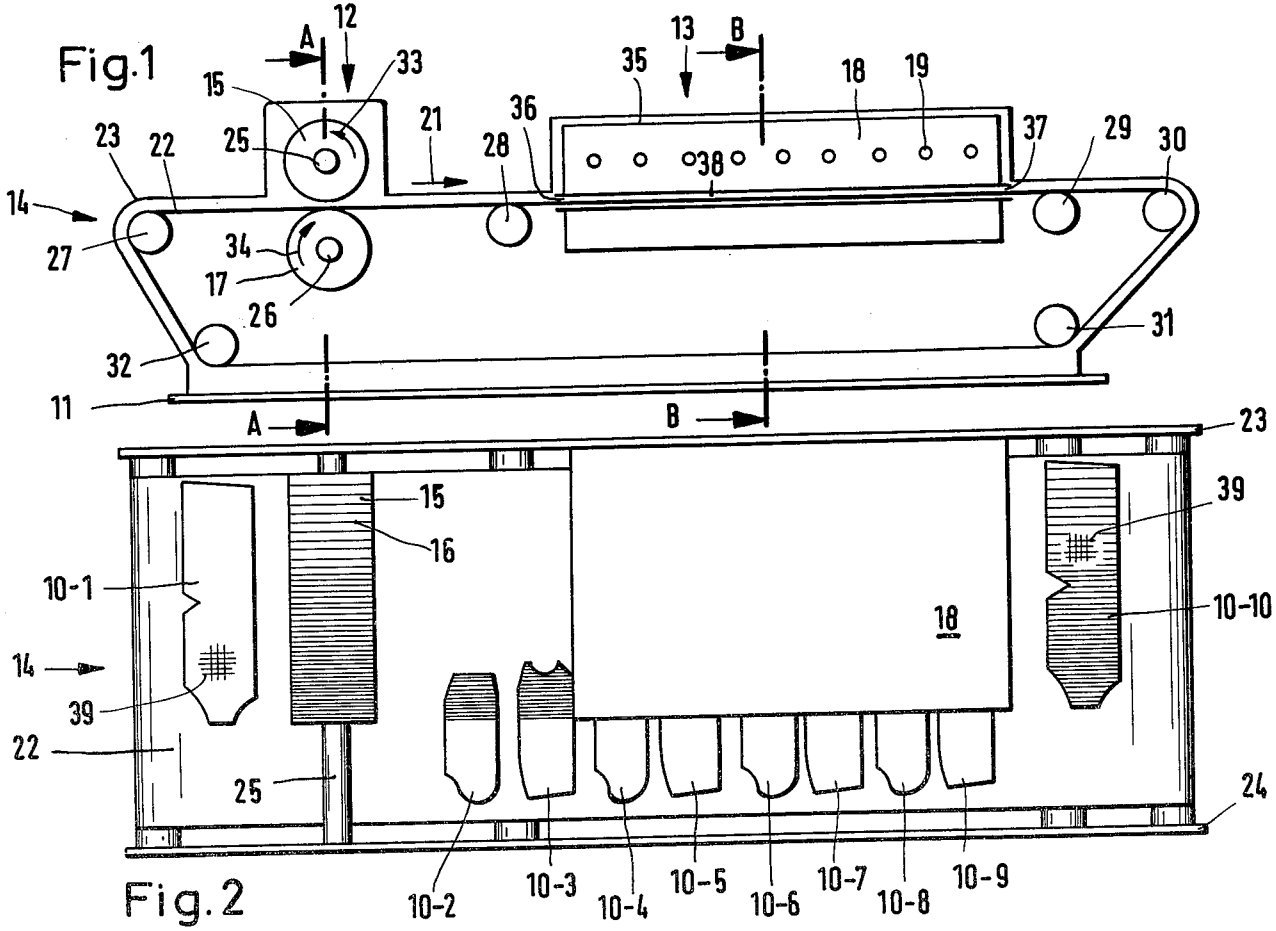
FIG. 1 is a longitudinal section through the device.
FIG.2 is a top view of the device according to FIG. 1 with textile fabrics coated and to be coated.
Figure 3:
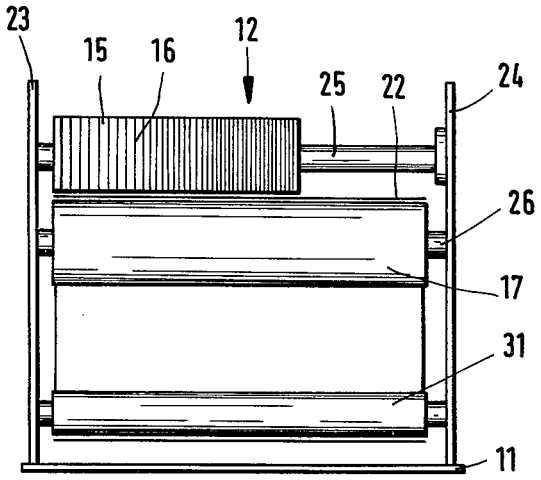
FIG. 3 is a cross section through the device for coating according to section line A—A in FIG. 1.
Figure 4:
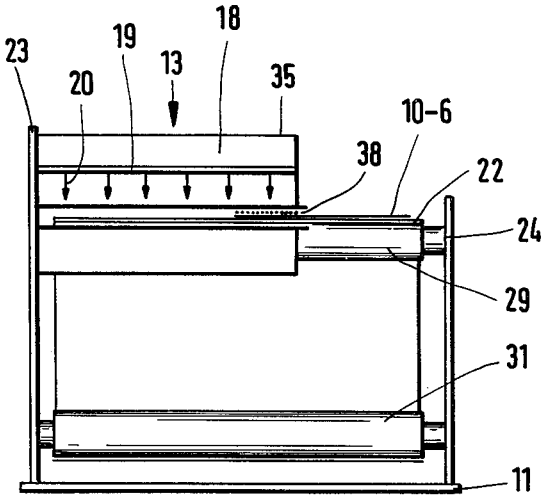
FIG. 4 is a cross section through the device for heat treating according to section line B—B in FIG. 1, with coated textile fabrics.

The device illustrated in FIGS. 1 through 4 consists of a frame 11 with side walls 23, 24. A coating device 12, a heat treating device 13, and a belt-like transport device 14 are arranged between side walls. The coating device 12 basically consists of a compression cylinder 15 and a pressure roller 17. The compression cylinder is formed as a roller printing cylinder and the operational area thereof has a plurality of longitudinal zones with various line configurations which correspond to known configurations of multiple insets. The grooves 16 of these line configurations can be as illustrated, but may also follow a threaded or a wave-like pattern. The compression cylinder 15 and the pressure roller 17 have axles 25, 26, and are driven in the direction of arrows 33, 34 by known drive means (not shown).

The transport device 14 has a conveyor belt 22 which is guided over rollers 27 through 32, and which is driven in the direction of arrow 21 via the roller 30 by known drive means (also not shown).

The heat treating device 13 basically consists of a through-pass dryer 18. The housing 35 of the dryer has unsealed slots 36, 37 across the direction of conveyance of the belt 22 as well as a slot 38 running parallel to the direction of conveyance (arrow 21). The slot 38 is arranged such that fabrics 10-2 through 10-9 which are only partially coated and are lying on the conveyor belt 22 experience heat treatment only to the extent they are coated. The slots 36, 37, 38 have a height above the conveyor belt 22 of about 10mm. The heat is produced by tubular infrared radiation units 19. The arrows 20 (FIG. 4) show the direction of the heat radiation originating from these infrared units.

The apparatus has all other known elements and devices, not shown, necessary for its operation, such as means for introducing the plastic to the compression cylinder 15, and a device for cleaning plastic residue and the like from the conveyor belt.

In operation, the textile fabric piece 10-1 placed on the conveyor belt 22 by the operator of the device is conveyed in the direction of arrow 21 and thereby enters the nip between the pressure roller 17 and the compression cylinder 15. Because the grooves 16 of the compression cylinder have been previously filled with plastic by means not illustrated and the slot between the compression cylinder and the pressure roller is smaller than the thickness of the textile pieces and the conveyor belt 22, the piece is coated with lines of plastic as it passes through the slot. These coating lines lie parallel to the direction of conveyance of the transport device 14 or parallel to the woof direction 39 of the textile piece as a result of the radial arrangement of the grooves 16 on the periphery of the compression cylinder 15. In the course of its further transport the piece 10-1 passes into the dryer 18, where the moisture is first vaporized from the coating of the textile piece, whereafter the coating is hardened. The partially coated textile fabric pieces 10-2 through 10-9 only extend into the dryer 18 to the extend they are coated (FIG. 2), and the same is true of the heat treatment. At the end of the device the finished textile piece 10-10 is removed from the conveyor belt 22 by an operator. In place of the operator the mechanical removing and stacking of the coated pieces can also take place. It is also possible to cool the pieces after completion of the hardening, for example by conveying them over a water-cooled plate (not shown) by means of the conveyor belt 22.

What is claimed is:

1. In an apparatus for stiffening precut textile fabric pattern pieces of different shapes made from outerwear material by coating them with reinforcing lines of a plastic material and including a coating device comprising a compression cylinder for applying lines of plastic material to the textile pieces, a pass-through dryer for the subsequent heat treatment of the coated pieces, and transport belt means for conveying the pieces through the coating device and the dryer, the improvements characterized by:

(a) the compression cylinder being adjustably mounted and having a plurality of spaced, parallel grooves in its outer periphery lying substantially perpendicular to the cylinder axis for carrying the plastic material, (b) the transport belt means comprising a single endless conveyor belt, (c) the compression cylinder and the dryer extending from one side of the conveyor belt across only approximately two thirds of its width, and (d) the dryer including a housing disposed above the conveyor belt and having both end walls and one longitudinal side wall spaced approximately 10 mm above the conveyor belt to define both entry and exit slots as well as a side slot, whereby textile fabric pieces may be placed on the conveyor belt transverse to the direction of conveyance and positioned such that either their entire length or only a desired portion thereof passes under the compression cylinder and through the dryer.

2. The apparatus according to claim 1, wherein the compression cylinder is formed for roller printing, and a plurality of zones being different radial line configurations are provided longitudinally across the length of the cylinder.

3. Apparatus according to claim 2, wherein the zone with the line configuration which produces the strongest coating is arranged at the end of the compression cylinder beyond which the conveyor belt extends by about one third of its width.

* * * * *